United States Patent [19]

Scott

[11] 4,289,246

[45] Sep. 15, 1981

[54] FREE STANDING MERCHANDISER

[76] Inventor: George B. Scott, 1375 Phoenix Dr., Des Plaines, Ill. 60018

[21] Appl. No.: 42,012

[22] Filed: May 24, 1979

[51] Int. Cl.[3] ..... B61G 1/00; E04G 5/06

[52] U.S. Cl. ..... 211/205; 211/131; 211/181; 248/225.2

[58] Field of Search ..... 211/205, 131, 181; 248/225.2

[56] References Cited

U.S. PATENT DOCUMENTS

| | | | |
|---|---|---|---|
| D. 162,990 | 4/1951 | Roeder | 211/181 |
| 1,163,038 | 12/1915 | Robertson et al. | 211/181 |
| 1,485,852 | 3/1924 | Jarvis | 211/181 |
| 1,682,855 | 9/1928 | Rose | 211/181 |
| 2,023,804 | 12/1935 | Donalies et al. | 211/181 |
| 2,972,414 | 2/1961 | Sipe | 211/181 |
| 3,524,616 | 8/1970 | Marschak | 211/205 |
| 3,692,617 | 9/1972 | Marks et al. | 211/205 |
| 3,972,499 | 8/1976 | Simmons | 248/225.2 |
| 3,995,744 | 12/1976 | Metcalf | 211/131 |

*Primary Examiner*—Victor N. Sakran

*Attorney, Agent, or Firm*—Fitch, Even, Tabin, Flannery & Welsh

[57] ABSTRACT

A free standing merchandiser or wire display rack is disclosed having a carrier detachably connected to a support means for supporting display merchandise such as books, food, or the like. The support means is formed as two elongated horizontally disposed spaced support rods that are offset both horizontally and vertically from one another with the upper support rod being located forwardly of the lower support element. The carrier has framework for supporting the displayed merchandise, and parallel mounting arms rearwardly upstanding from the framework terminating in novel hooks which hook onto a pair of spaced support rods. The hooks are formed with a first contiguous arm segment backfolded or angled relative to the upper part of the mounting arm to define a V-bend therebetween, and a second contiguous arm segment bent or angled relative to the first arm segment to extend in a direction away from the V-bend and the upper arm part. When the carrier is mounted on and connected to the support rods, the V-bend overlies the upper and forward support element presenting a smooth surface to the merchandise in the carrier while the first contiguous arm segment fits between the two support elements, and the second contiguous arm segment underlies the lower and rearward support element. These hooks with the V-bends therein can be fabricated to relatively close tolerances to define a relatively constant angle of inclination for each of the carriers.

5 Claims, 6 Drawing Figures

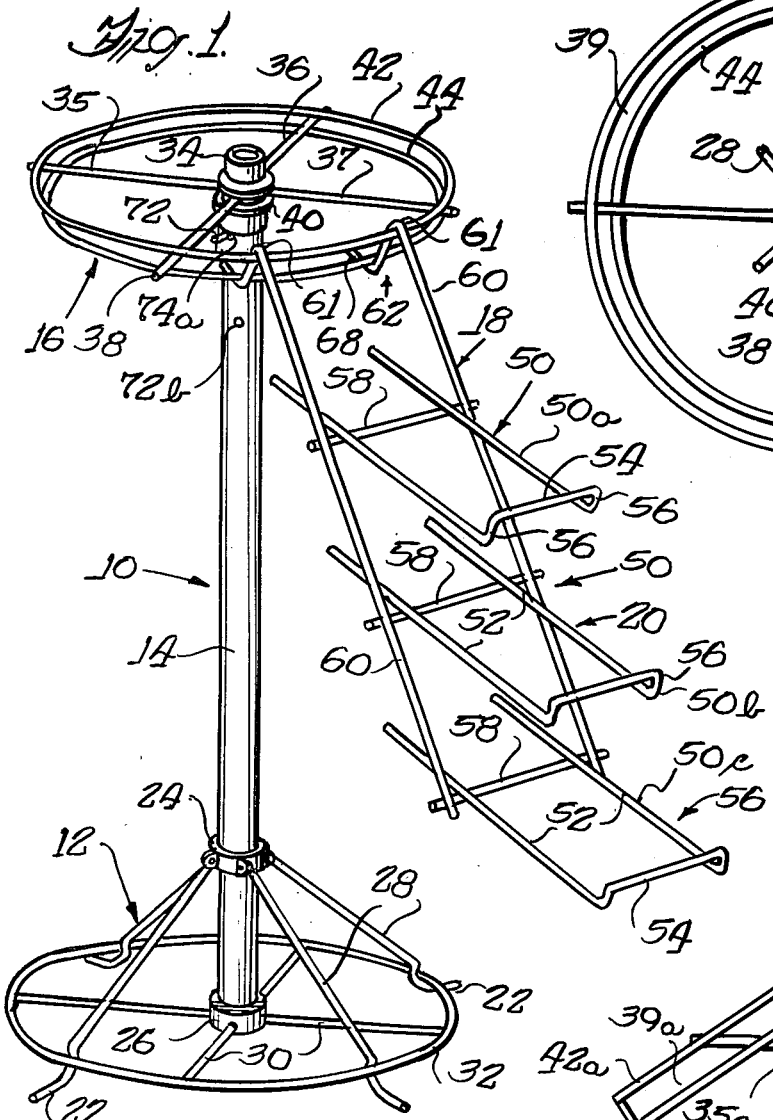
Fig. 1.
35
36
42
44
34
37
72
40
61
60
74a
16
38
72b
68
18
50
58
50a
54
56
10
14
52
20
50b
50c
24
12
28
22
26
30
32
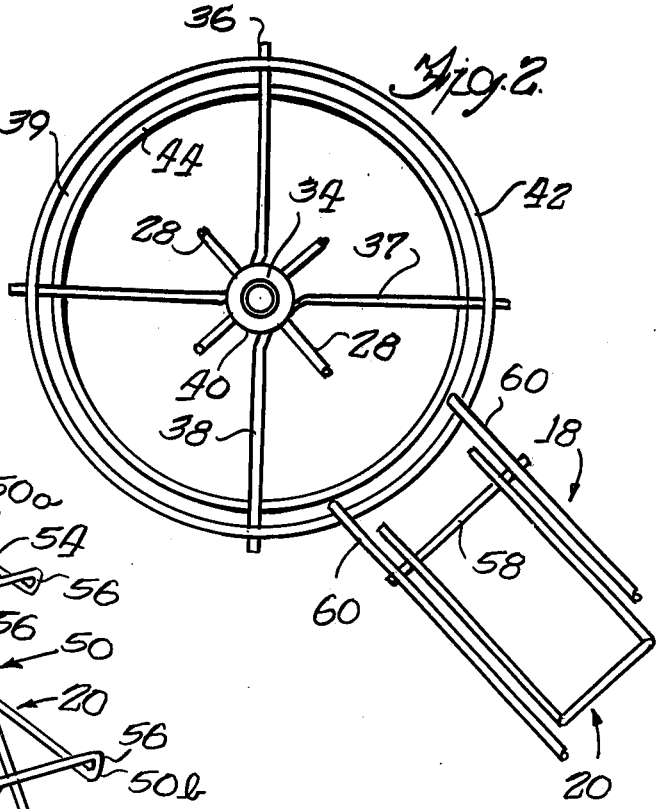
Fig. 2.
36
39
44
34
42
28
37
40
38
60
18
58
20
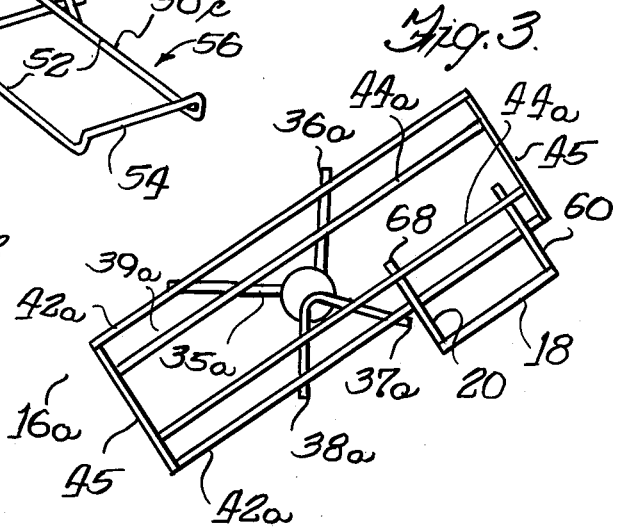
Fig. 3.
44a
36a
45
68
60
39a
42a
35a
37a
20
18
16a
38a
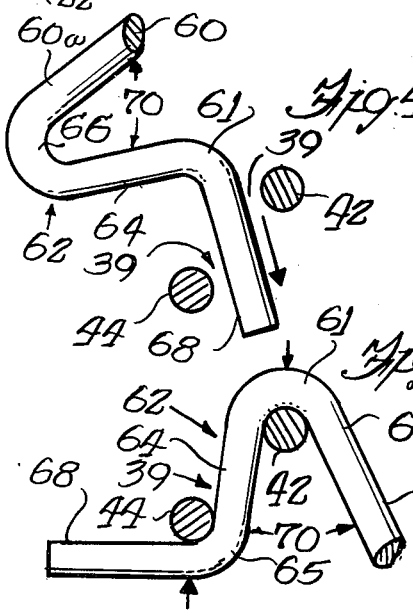
Fig. 4.
60a
60
70
66
61
39
42
62
64
44
68
Fig. 5.
61
62
60a
64
39
42
60
68
44
70
65
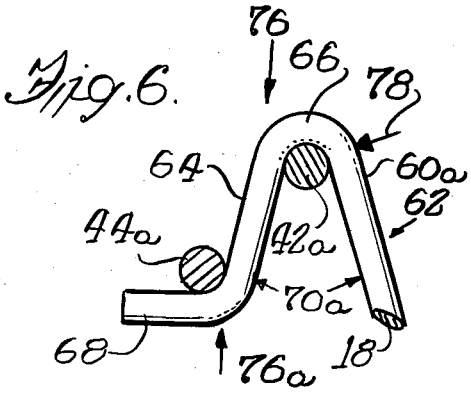
Fig. 6.
76
66
78
64
60a
62
44a
42a
70a
68
76a
18

FREE STANDING MERCHANDISER

BACKGROUND OF THE INVENTION

Wire display racks, stands or merchandisers of the free standing type are commonplace in the marketing of many small products that are stored or displayed in groups, where the desired product can be taken individually as needed from the displayed group by the purchaser. Typically, these free standing merchandisers have a base supporting an upstanding shaft which has mounted thereon a circular ring-shaped support to which are detachably connected a number of basket-like carriers. The products, e.g. paperback books, are stacked in the carrier for perusal by customers. Such a merchandiser must be rigid and sturdy when set up, in order to support the displayed products safely and attractively. The merchandiser should also be fabricated and assembled without the use of tools or complex procedures. The displayed products must be easily removed from the carriers without subjecting the product or the purchaser to any rough or sharp edges or the like which might damage the product or injure the purchaser. Still further, the merchandiser should be capable of being readily set up or assembled, and knocked down or disassembled to provide for a versatile marketing tool that can be collapsed and compactly stored when not needed but yet can be easily used at varying locations. The manufacturing cost must be low.

U.S. Pat. No. 3,995,744 illustrates a merchandiser of this general kind but which has been found to have a number of shortcomings. One noted shortcoming exhibited in the patented merchandiser is that the carriers are connected to the ring-shaped support by C-shaped hooks having sharp or raw exposed edges against which the rearward most held product is typically pressed, which edges are likely to damage the product or further are likely to scrape or injure the purchaser attempting to remove the product from the merchandiser. Secondly, these small C-shaped hooks are difficult to fabricate accurately enough to maintain the desired angle of inclination of the carrier to the support.

SUMMARY OF THE INVENTION

This invention is directed to a free standing merchandiser of the type consisting generally of a stand, a column upstanding from the stand, support means carried at the upper end of the column, and a carrier detachably connected to the support means in a novel manner and having framework suited to hold products or merchandise to be frontally displayed. The novel connection comprises a ring support means having two radially spaced, upper and lower rods with a hooked end on the carrier arms hooked over and below the rods. More specifically, the hooks are formed without a sharp C-shaped end but rather have at the upper and outer ring a superimposed and downwardly facing V-bend. The V-bend is formed by first and second contiguous arms angled relative to each other with the second arm extending rearwardly and in a direction away from the V-bend and from the upper arm. The ring support means is in the form of two parallel elongated elements spaced apart and offset both vertically and horizontally from one another, where the upper of these elements is forward of the lower element. The carrier mounting arms, when attached on the support means, are disposed transversely of the spaced support elements with the V-bend overlying the upper element, the first contiguous arm segment fitting tangentially between the two spaced support elements, and the second contiguous arm segment underlying the lower support element.

In the preferred embodiment, the V-bend is the apex of an included angle defined between the upper arm part and the first contiguous arm segment, and the included angle is of the order of approximately 120° and 170°. The support elements and the mounting arms are each preferably formed of a cylindrical wire stock sized between approximately 3/16ths and ⅜th inch in diameter, and the apex at the V-bend is rounded across a diameter substantially the same as the diameter of the wire stock. The contiguous arm segments on the hook configuration each is of the order of between approximately ½ and 1¼ inches in length. The support elements are typically in the form of an endless loop and they are spaced apart between approximately two and five times the diameter of the wire stock, so that with a wire stock of approximately 3/16ths inch in diameter, the spacing between the two support elements is at least ⅜ths of an inch and can be as much as an inch.

BRIEF DESCRIPTION OF THE DRAWINGS

FIG. 1 is a perspective view illustrating a free standing merchandiser, specifically showing a preferred embodiment of a ring support means and a carrier having a hook configuration designed to be detachably connected to the support means;

FIG. 2 is a top plan view of the merchandiser illustrated in FIG. 1;

FIG. 3 is a top plan view of an alternate embodiment of a merchandiser having a support means with straight sides;

FIGS. 4 and 5 are enlarged sectional views showing in FIG. 4 the initial sequence of manipulation of the carrier hook configuration relative to the support means in order to attach the carrier to the support means and showing in FIG. 5 the final cooperating fit of the carrier hook configuration relative to the support means; and FIG. 6 is an enlarged sectional view as seen generally, showing a probable cooperating fit of the carrier hook configuration relative to the support means of FIG. 3.

DETAILED DESCRIPTION OF THE INVENTION

In FIG. 1, a free standing merchandiser 10 is illustrated and consists of a stand or base 12, a column 14 that upstands from the stand or base 12, a ring type support means 16 that is carried at the upper end of the column 14, and a carrier 18 that is detachably connected to the support means 16 and that includes framework 20 suited to hold merchandise (not shown) to be frontally displayed. Although only one carrier 18 is illustrated on the merchandiser 10, it is understood that more of them can be used at spaced locations around the support means 16. Also, various other shapes of carriers, such as basket shaped carriers for receiving a supply of paper-backed novels, may be provided.

The merchandiser 10 is free standing in that the stand or base 12 has four spaced feet 22 designed to rest on the supporting floor or the like in the area where the merchandiser is to be set up. The stand or base 12 further includes spaced hub means 24 and 26, at least the top hub 24 of which is tubular to provide for the insertion therethrough of the column 14. Radial arms 28 and 30 are connected at their inboard ends to the hubs 24 and 26 respectively and are connected adjacent their outboard ends to a ring member 32. This provides for the rigid support of the hubs 24 and 26 in general vertical alignment when the feet 22 are supported on a level horizontal floor or support surface. The hub 26 typically would have stop means (not shown) formed therein to act in effect as a thrust unit against which the lower end of column 14 rests. Typically, the stand 10 is a knock-down unit for assembly at the user's location. The lower portion of the stand 10 may take various other shapes and forms and still fall within the purview of the invention.

The column in turn typically is a tubular element that fits in rather snug relationship within or through the bore of the hub 24 and into the hub 26 and against the stop therein, while the upper end can be opened and or capped.

The support means 16 in the embodiment of FIGS. 1 and 2 includes a central hub 34 which preferably has an inner bore just slightly oversized to the exterior of the column 14 designed thereby to telescope over the upper end of the column. Radial arm means 35, 36, 37 and 38 are secured as by spot welds or the like between two spaced washer like disc elements 40, where the disc elements 40 themselves are spot welded or the like to the tubular hub 34. In the illustrated embodiment, the respective arms 35 and 36, and 37 and 38 are formed from single wire elements each bent across approximately a 90° angle and the apex of each arm is secured between the two spaced disc elements 40. The support means further includes spaced endless rings or support rods 42 and 44 which in the illustrated embodiment are preferably in the form of concentric circles. In the illustrated embodiment, the upper support ring is larger in diameter than the diameter of the lower support ring 44. The upper and lower rings are spot welded on the opposite sides of the support arms 35, 36, 37 and 38. This can be seen in perspective view in FIGS. 1 and 2, for example, in which the larger diameter ring 42 is secured to the top side of the radially extending rod arms 35, 36, 37 and 38 and the inner smaller diameter ring 44 is secured to the underside of the rod arms 35, 36, 37 and 38. As best seen in FIG. 2, the large diameter ring 42 is radially offset from the inner diameter ring by a space 39 which is substantially annular in shape.

The embodiment illustrated in FIG. 3 shows a support means 16*a* having straight parallel support elements 42*a* and 44*a* which are formed from straight wire elements but which are spaced from each other by a space 39*a*, that is, the upper support element 42*a* is horizontally offset from the lower support element 44*a* and is disposed forwardly thereof. The support elements are preferably connected together at their free ends by cross elements 45, and can also be secured to opposite sides of radial arms 35*a*, 36*a*, 37*a* and 38*a* as in the embodiment of FIGS. 1 and 2. The upper and lower, and inner and outer relationship of the support elements 42*a* and 44*a* is illustrated in FIG. 6.

The illustrated carrier 18 includes the framework 20 previously mentioned which comprises three shelf elements 50 formed from U-shaped wires with a pair of side legs 52 and an upstanding slightly raised intermediate leg 54. The latter is connected by offset portions 56 to the side legs 52. The side legs 52 are each secured by spot welds or the like to one of three spaced horizontal support bars 58 which are carried on a pair of mounting arms 60. The mounting arms 60 extend upwardly to hook means 62 which are hooked to the rings 42 and 44 in a novel manner, as will be explained. The illustrated framework 20 of the carrier 18 is suitably designed to support boxes for example of the type that might hold packaged gum, candy bars, or the like in a clustered or grouped arrangement. There further typically is sufficient space to allow a person to reach between the adjacent support element 50*a*, 50*b*, and 50*c* for example in order to remove individual packages or the like contained within the box supported thereon. The specific configuration of the framework is illustrated to provide a background for a typical merchandiser framework to be hooked to the support rings 42 and 44.

The carriers 18 are preferably hooked to the support rings so that they may not be accidentally disconnected therefrom by a person brushing or bumping against the same. Specifically, it should take a deliberate act of raising the carrier 20 upwardly to about the horizontal plane of the rings 42 and 44 before an end 68 of the hook means 62 may be threaded and lifted through the space 39, as best seen in FIG. 4 to disconnect the hook means from the rings 42 and 44. Of course, the opposite motion is illustrated by the arrows in FIG. 4, namely, an assembly operation including the inserting of ends 68 down through the space 39 to be followed by a clockwise swinging of the carrier 18 to position the hook ends 68 beneath the inner ring 44, as best seen in FIG. 5. Because rigid wire stock is used to form both the hook means 62 and the rings 42 and 44, the assembly or disassembly of the carrier 18 to the ring support is made without any metal bending, either by hand or with tools. The erection should be quick, simple, readily understood, and substantially foolproof to satisfy commercial requirements.

In the aforementioned patent, the upper ends of C-shaped hooks were disposed to project radially outwardly and caused tears on paperback books and sometimes scratched the hands of the customers. Also, these very small C-shaped hooks were difficult to form accurately enough to have the depending support legs held at a constant angle to the vertical. That is, the various baskets were inclined at different angles to the close to substantial tolerance variations in the C-shaped hook configuration.

In accordance with the present invention, the outwardly projecting blunt end and better control of the angle of the carrier to the support have been achieved with a new improved hook means 62 and a novel manner of cooperation thereof with a pair of non-parallel rings 42 and 44.

The preferred and illustrated hook means 62 will now be described in greater detail. Herein, the carrier arms 60 extend up to and are bent over the top of the upper ring 42 providing a smooth top bend 61 which will not scratch or tear, as does the prior ends of C-shaped hooks shown in U.S. Pat. No. 3,995,744. The upper bend 61 has an inner radius bend approximating the outer diameter of the upper ring wire, as shown in FIG. 5. From the upper bend 61, the wire for each support leg is bent down to form a leg 64 which defines an included angle 70 with the straight support arm 60. The included angle 70 determines the angular relationship of the carrier arms 60 to the vertical. Because the legs 64 are relatively long, they can be bent and held to relatively precise tolerances relative to the straight arms 60 thereby allowing for a relatively constant angle 70 and angular relationship for the carrier arms 60 to the vertical. The legs 64 extend downwardly and inwardly through the space 39 to a bend 65 having an inner radius approximating the curvature of the outer surface of the lower ring 44. From the bend 65, a straight end 68 extends generally horizontally beneath the lower ring 44 and is directed inwardly with its distal end positioned out of the way of scratching anything.

The load imposed on the carriers 18 by the goods will exert a downward pull on the hook bend 61 against the upper surface of the top ring 42. The weight of the goods will also exert a turning torque trying to pivot the leg 64 of the hook means to turn upwardly and in a clockwise direction about the upper rod 42. However, the lower bend 65 will engage the lower portion of the lower inner rod 44 and prevent such turning of the hook means and the legs 64. Thus, good stability and load bearing capacity are provided by the hook means 62.

In the preferred embodiment of the mounting arm structure is of cylindrical wire stock having a diameter of between approximately 3/16ths and ⅜ths inches. This is sufficiently lightweight to be accurately cold formed while yet is sufficiently durable to withstand the loads of merchandise supported and displayed on this type of merchandiser. Further, the V-bend 66 is in effect an apex of an included angle 70 (FIG. 4) defined between the upper arm part 60*a* and the first contiguous arm segment 64. The included angle is preferably in the order of between 120° and 170°, which means that the first contiguous arm segment when formed is back-folded toward the upper arm part 60*a*. However in forming the apex it is preferred that the apex is rounded across a diameter substantially the same as the diameter of the wire stock used in forming the upper support element 42 or 42*a* of the support means 16 or 16*a*. The arm segments 64 and 68 each is of the order of between approximately ½ inch and 1¼ inches in length. This can be translated to approximately between two and five times the diameter of the wire stock used in forming the support arms. This allows for firm fixturing of the arms as required in order to cold form them from straight wire stock into the required hook configuration. The consistency of being able to form such a hook configuration thereby increases the reliability of the merchandiser in question and its acceptance in use.

In the preferred embodiment, the support elements 42 and 44, and 42*a* and 44*a*, are formed of cylindrical wire stock having a diameter of between approximately 3/16ths and ⅜ths of an inch. This provides a certain degree of flexibility for cold forming the stock while yet generally provides a support of sufficient strength and rigidity for stably supporting the carrier to be securely and detachably mounted thereon. Also, in the preferred embodiment, there typically is a space or distance between the upper and lower support element 42 and 44, or 42*a* and 44*a*, of between two and five times the diameter of the wire stock used to form the mounting arms. For 3/16ths inch wire stock, this spacing is of the order of ⅜ths of an inch and can be an inch or more.

The support means 16, or 16*a*, can be held on the column 14 at any of several adjustable heights, by means for example of a pin 72 extended through openings 74*a* and 74*b* in the column, where the hub 34 rests on the protruding ends of the pin 72.

The carrier can be easily attached onto the support means merely by inserting initially the second arm segment 68 between the upper and lower support elements 42 and 44 or 42*a* and 44*a* respectively from an inward location and in a downward direction as seen in FIG. 5. In order to do this, it is necessary to elevate the carrier framework relative to the carrier hook configuration such as by rotating the carrier in a counterclockwise direction as seen from the left in FIG. 1. Once the second arm segment 68 has been positioned through the gap between the support elements 42 and 44 or 42*a* and 44*a* and the upper part 60*a* of the mounting arms 60 engages the upper support 42 (or 42*a*), as illustrated in FIG. 4, the carrier 18 can be rotated in a clockwise direction to the position illustrated in FIG. 5. The carrier 18 can be removed from the support means 16 (or 16*a*) by simply rotating the carrier in a counterclockwise direction relative to FIG. 1 and lifting the hook configuration until the first contiguous arm segment 64 clears the upper and outer ring support member 42 or 42*a*.

As best seen in FIG. 6, the straight support elements 42*a* and 44*a*, the V-bend in the disclosed hook configuration overlies the uppermost ring or support element 42*a*. This thereby provides that the main vertical load incurred by the weight of the merchandise supported on the carrier is assumed vertically between the hook configuration and support. Secondly, the first contiguous arm portion extends between the two spaced support elements 42*a* and 44*a* and tangentially engages these elements. This cooperation provides accurate orientation of the carrier framework 20 relative to the support means 16*a*, merely by controlling the included angle 70 of the V-bend 66, and its cooperation with the spacing and offset of the ring supports 42*a* and 44*a*. Further, the second contiguous arm segment 68 underlies the lower ring support element 44*a* and also extends in a horizontal direction preferably rearwardly away from the V-bend 66 and further from the upper part 60*a* of the mounting arm 60. This reliably holds the positioned carrier relative to the support means 16*a*. As noted, the interfitting of the hook configuration relative to the support means causes a coupling action with the load or force components disposed mainly in the vertical direction, as indicated by the arrows 76 and 76*a* in FIG. 6, for reliably holding the carrier on the support means and thereby precluding the accidental disengagement of the carrier from the support means.

Also of interest in the suitability of the disclosed hook configuration and the offset arrangement of the upper-outer and inner-lower support elements 42 or 42*a* and 44 or 44*a* respectively, is that when the carrier is initially placed on the support elements in an unloaded manner a tight abutment is established between adjacent surfaces of the hook configuration and of the support elements. When a load is subsequently applied to the carrier, any flexure of the hook configuration in the area of the V-bend is such that it tightens around the support member further maintaining a snug or secure cooperation between the hook configuration and the support elements.

Thus, the hook configuration 62, formed of straight arm segments 64 and 68 angled around curved or rounded bends relative to one another and to the upper straight parts 60*a* of the mounting arms 60, are quite accurately formed and operate very effectively to compensate for nonperfect cooperative fit with the varying support means onto which the carrier 18 might be connected.

From the foregoing, it will be seen that the present invention provides an improved merchandiser which does not readily unhook and which has smooth curved portions facing the merchandise so as not to tear the same. Of course, the carrier may be a basket shape such as shown in U.S. Pat. No. 3,995,744 except for the connections to the rings in which case the rear hook in the basket will not be torn by the ends of C-shaped hooks. The controlled angle 70 provides for better orientation of the carrier. Thus, it will be seen that the present invention provides a new improved construction over that used heretofore.

What is claimed is:

1. A freestanding merchandiser of the type consisting of a stand, a column upstanding from the stand, support means carried at the upper end of the column, and a carrier detachably connected to the support means and having framework suited to hold merchandise to be frontally displayed, the improved combination comprising said support means being in the form of two elongated elements spaced apart and offset both vertically and horizontally from one another, where one of the elements is disposed forwardly of the other of the elements, said elements being in the form of rings with the upper ring having a larger diameter than the lower one of the rings, said carrier having a pair of mounting arms upstanding rearwardly from the framework, and a hook configuration formed on the upper end of each arm from an uppermost part of the arm, a first contiguous arm segment angled relative to the upper arm part and defining therebetween a downwardly facing V-Bend superimposed on the upper side of said upper ring, and a second contiguous arm segment to extend rearwardly and radially toward said column and in a direction away from the V-Bend and from the uppermost arm part and disposed under said lower ring; said first contiguous arm segment fitting between the two spaced support rings, and the second contiguous arm segment underlying the lower support ring.

2. A freestanding merchandiser according to claim 1, wherein the V-bend is the apex of an included angle defined between the upper arm part and the first contiguous arm segment and said included angle is of the order of approximately between 120° and 170°.

3. A freestanding merchandiser according to claim 1, wherein the support elements and mounting arms are each in the form of cylindrical wire stock between approximately 3/16th and ⅜ths of an inch in diameter, and wherein said apex between the upper arm part and the first contiguous arm segment is rounded across a diameter substantially the same as the diameter of the wire stock.

4. A freestanding merchandiser according to either claim 1, 2 or 3, wherein each contiguous arm segment is of the order of between approximately ½ and 1¼ inches in length.

5. A freestanding merchandiser according to claim 3, wherein each of said support elements is in the form of an endless loop, and wherein said support elements are spaced apart a distance of the order of between approximately two and five times the diameter of the wire stock.

* * * * *